US009384703B2

(12) United States Patent
Bloks et al.

(10) Patent No.: US 9,384,703 B2
(45) Date of Patent: Jul. 5, 2016

(54) TECHNIQUES FOR AVOIDING AND REMEDYING DC BIAS BUILDUP ON A FLAT PANEL VARIABLE REFRESH RATE DISPLAY

(71) Applicant: Nvidia Corporation, Santa Clara, CA (US)

(72) Inventors: Rudolf Bloks, Sunnyvale, CA (US); Robert Schutten, San Jose, CA (US); Tom Verbeure, Sunnyvale, CA (US)

(73) Assignee: NVIDIA Corporation, Santa Clara, CA (US)

( * ) Notice: Subject to any disclaimer, the term of this patent is extended or adjusted under 35 U.S.C. 154(b) by 11 days.

(21) Appl. No.: 14/190,866

(22) Filed: Feb. 26, 2014

(65) Prior Publication Data

US 2015/0243234 A1 Aug. 27, 2015

(51) Int. Cl.
*G09G 3/36* (2006.01)

(52) U.S. Cl.
CPC ..... *G09G 3/3614* (2013.01); *G09G 3/3618* (2013.01); *G09G 2310/02* (2013.01); *G09G 2310/08* (2013.01); *G09G 2320/02* (2013.01)

(58) Field of Classification Search
CPC ..... G09G 2320/0247; G09G 2340/0435; G09G 3/3614; G09G 3/3618
USPC ..... 345/96
See application file for complete search history.

(56) References Cited

U.S. PATENT DOCUMENTS

| | | | | |
|---|---|---|---|---|
| 2005/0212740 | A1* | 9/2005 | Miyagawa | 345/89 |
| 2007/0109256 | A1* | 5/2007 | Fry | 345/156 |
| 2007/0120793 | A1 | 5/2007 | Kimura | |
| 2008/0309656 | A1 | 12/2008 | Van Woudenberg et al. | |
| 2009/0179923 | A1 | 7/2009 | Amundson et al. | |
| 2010/0253611 | A1 | 10/2010 | Takagi et al. | |
| 2011/0285683 | A1 | 11/2011 | Todorovich et al. | |
| 2012/0176396 | A1 | 7/2012 | Harper et al. | |
| 2013/0249880 | A1 | 9/2013 | Chen et al. | |
| 2014/0368484 | A1* | 12/2014 | Tanaka et al. | 345/208 |
| 2015/0194111 | A1 | 7/2015 | Slavenburg et al. | |
| 2015/0243233 | A1 | 8/2015 | Bloks et al. | |

* cited by examiner

*Primary Examiner* — Koosha Sharifi-Tafreshi

(57) ABSTRACT

A method for driving a display panel having a variable refresh rate is disclosed. The method comprises receiving a current input frame from an image source. It also comprises determining a first number of re-scanned frames to insert between the current input frame and a subsequent input frame, wherein the re-scanned frames repeat the current input frame, and wherein the determining depends on a minimum refresh interval (MRI) of the display panel. Further, it comprises calculating intervals to insert the first number of re-scanned frames between the current input frame and the subsequent input frame. Further, it comprises scanning the current input frame for display on the display panel. Finally it comprises inserting the first number of re-scanned frames at the respective intervals between the current input frame and the subsequent input frame from the image source, wherein the inserting is operable to reduce charge accumulation in the display panel.

21 Claims, 12 Drawing Sheets

230
240

| Frame Nr | Frame Arrival Time (ms) | LCD Refresh Start Time (ms) | Duration (ms) | Polarity | Comment |
|---|---|---|---|---|---|
| 1 | 0 | 0 | 30 | + | |
| 1' | | 30 | 10 | - | Frame 1 repeat |
| 2 | 40 | 40 | 30 | + | |
| 2' | | 70 | 10 | - | Frame 2 repeat |

| Frame Nr | Frame Arrival Time (ms) | LCD Refresh Start Time (ms) | Duration (ms) | Polarity | Comment |
|---|---|---|---|---|---|
| 1 | 0 | 0 | 20 | + | |
| 1' | | 20 | 20 | - | Frame 1 repeat. Duration constant at 20ms. |
| 2 | 40 | 40 | 20 | + | |
| 2' | | 60 | 20 | - | Frame 2 repeat. Duration constant at 20ms. |

530
531

| Input frame Nr | Input frame arrival time (ms) | Scan-out start time (ms) | First scan-out (Y/N) | Duration on screen (ms) | Polarity | Comment |
|---|---|---|---|---|---|---|
| 0 | 0 | 0 | Y | 30 | + | MRI=30, non-equi-distant rescans |
| | | 30 | N | 10 | - | |
| 1 | 40 | 40 | Y | 30 | + | |
| | | 70 | N | 10 | - | |
| 2 | 80 | 80 | Y | 30 | + | |

532
533
534

| Input frame Nr | Input frame arrival time (ms) | Scan-out start time (ms) | First scan-out (Y/N) | Duration on screen (ms) | Polarity | Comment |
|---|---|---|---|---|---|---|
| 0 | 0 | 0 | Y | 20 | + | equi-distant rescans |
| | | 20 | N | 20 | - | |
| 1 | 40 | 40 | Y | 20 | + | |
| | | 60 | N | 20 | - | |
| 2 | 80 | 80 | Y | 20 | + | |

| | Input frame Nr | Input frame arrival time (ms) | Scan-out start time (ms) | First scan-out (Y/N) | Duration on screen (ms) | Polarity | Comment |
|---|---|---|---|---|---|---|---|
| 632 | 0 | 0 | 0 | Y | 20 | + | non-equi-distant rescans |
| 633 | | | 20 | N | 10 | - | |
| 634 | | | 30 | N | 10 | + | |
| | 1 | 40 | 40 | Y | 20 | - | frame2, inverted polarity from 1 |
| 635 | | | 60 | N | 10 | + | |
| 636 | | | 70 | N | 10 | - | |
| 637 | 2 | 80 | 80 | Y | 20 | + | |

| Input frame Nr | Input frame arrival time (ms) | Scan-out start time (ms) | First scan-out (Y/N) | Duration on screen (ms) | Polarity | Comment |
|---|---|---|---|---|---|---|
| 0 | 0 | 0 | Y | 16.7 | + | calculated equi-distant rescans |
| | | 16.7 | N | 16.7 | - | (even count if possible) |
| | | 33.3 | N | 16.7 | + | |
| 1 | 50 | 50 | Y | 16.7 | - | frame2, inverted polarity from 1 |
| | | 66.7 | N | 16.7 | + | |
| | | 83.3 | N | 16.7 | - | |
| 2 | 100 | 100 | Y | 16.7 | + | |

832
833
834
835
836
837

FIG. 8

1037

| Input frame Nr | Input frame arrival time (ms) | Scan-out start time (ms) | First scan-out (Y/N) | Duration on screen (ms) | Polarity | Comment |
|---|---|---|---|---|---|---|
| 0 | 0 | 0 | Y | 16 | + | no rescans |
| 1 | 16 | 16 | Y | 14 | - | |
| 2 | 30 | 30 | Y | 16 | + | POS polarity for even frames, and NEG polarity for odd frames |
| 3 | 46 | 46 | Y | 14 | - | |
| ... | | | | | | |
| ... | | | | | | |
| 97 | 1456 | 1456 | Y | 14 | - | |
| 98 | 1470 | 1470 | Y | 16 | + | |
| 99 | 1486 | 1486 | Y | 8 | - | DC too high! -> force extra rescan |
| | | 1494 | N | 8 | + | extra scan – causes inversion |
| 100 | 1500 | 1502 | Y | 14 | - | 2 ms delayed scan-out (collision) |
| 101 | 1516 | 1516 | Y | 14 | + | POS polarity for odd frames, and NEG polarity for even frames |
| 102 | 1530 | 1530 | Y | 16 | - | |
| 103 | 1546 | 1546 | Y | 14 | + | |
| ... | | | | | | |

FIG. 10

| N-8 | N-7 | N-6 | N-5 | N-4 | N-3 | N-2 | N-1 | N |
|---|---|---|---|---|---|---|---|---|
| neg | pos | pos | neg | neg | pos | pos | neg | neg |

FIG. 12A

| N-8 | N-7 | N-6 | N-5 | N-4 | N-3 | N-2 | N-1 | N |
|---|---|---|---|---|---|---|---|---|
| pos | pos | pos | neg | neg | neg | neg | neg | neg |

FIG. 12B

TECHNIQUES FOR AVOIDING AND REMEDYING DC BIAS BUILDUP ON A FLAT PANEL VARIABLE REFRESH RATE DISPLAY

CROSS-REFERENCE TO RELATED APPLICATIONS

Related Applications

The present application is related to U.S. patent application Ser. No. 14/147,365, filed Jan. 3, 2014, entitled "DC BALANCING TECHNIQUES FOR A VARIABLE REFRESH RATE DISPLAY," naming Gerrit Slavenburg, Robert Schutten and Tom Verbeure as inventors. That application is incorporated herein by reference in its entirety and for all purposes.

BACKGROUND OF THE INVENTION

Traditionally, liquid crystal displays (LCDs) had a fixed refresh rate, wherein the contents of the screen are refreshed at fixed time intervals, e.g., at 60 Hz. While fixed refresh rates perform adequately for certain applications, e.g., T.V. shows, other applications, e.g., gaming suffers. Depending on the complexity of the calculations, the graphics processing unit (GPU) used to render gaming graphics for an LCD display typically renders frames at varying rates. The difference in the rendering rate of the GPU and the fixed refresh rate of the LCD can result in conspicuous visual artifacts that distort a user's experience of the game.

Variable refresh rate monitors alleviate this problem by requiring the LCD screen to sync with the GPU instead of refreshing at a fixed rate. The GPU sends an image to the LCD as soon as it is rendered and the LCD monitor repaints the image. Subsequently, the LCD waits for the next image to be transmitted from the GPU. This reduces visual artifacts like stutter and tearing and results in smoother on-screen motion. However, because of the variable refresh rate, each RGB component of a pixel can start to accumulate charge if positive and negative polarity frame durations are not equal because of an unbalanced polarity pattern (also called a beat pattern).

The intensity of each one of the RGB components of a pixel of a liquid crystal display ("LCD") is determined by the voltage difference that is applied to the pixel cell. In the neutral state, no voltage is applied. In the active state, the voltage can either have positive or negative polarity. It should be noted that both positive and negative polarities result in the same intensity of color on the LCD screen. As the voltage is applied to a pixel cell, the RGB component of a pixel (hereinafter, each RGB component of a pixel will be referred to as a "pixel") may slowly accumulate a charge. When this charge is present, the intensity of the pixel will be different than when the charge is not present, even in cases where the same voltage is applied.

Over time, the charge accumulation inside a component dot of a pixel will result in visual artifacts. For example, the intensity of the pixel will be different when a positive voltage is applied than when a negative voltage of the same magnitude is applied. If the polarity changes for each frame displayed, the pixel will alternately have different values for the same applied voltage magnitude, which can be observed as significant flicker.

To avoid this charge accumulation and noticeable flicker, the driving electronics of the LCD panel need to ensure that the average charge in the pixels stays close to zero, which means that the average voltage applied over time should approximately be zero also. It should be noted that because the charge inside a pixel leaks away over time, similar to a leaky capacitor, the average voltage applied does not have to be exactly zero.

In a display with a fixed refresh rate, ensuring that the average voltage applied is zero can be accomplished by alternately applying a positive and negative voltage across the pixels. The polarity of the voltage on each pixel is typically changed for each frame for a regular 2D display, e.g., in the following pattern: (+−+−+−+−). For some stereo 3D displays, for example, the polarity of the voltage on each pixel may change in the following fashion: (++−−++−−++−−++).

In a variable rate display, however, ensuring that the average voltage charge applied stays close to zero is more challenging. Conventional variable rate LCD displays do not have an efficient or any mechanism for ensuring that the average voltage applied over time stays close to zero and, therefore, undesirable parasitic charge can build up for the pixels of the LCD screen which causes visible artifacts.

BRIEF SUMMARY OF THE INVENTION

Accordingly a need exists for a method and apparatus to prevent charge accumulation within the component dots of pixels in a variable refresh rate display. Embodiments of the present invention provide a method for avoiding charge accumulation and resultant visual artifacts by intelligently inserting repeat frames between input frames provided by a graphics processing unit (GPU) to a LCD monitor.

Embodiments of the present invention provide a method for preventing charge accumulation and resultant visual artifacts by dynamically analyzing a sequence of frames to detect any DC imbalance building up within the pixels of the LCD panel and performing a sequence of remediation countermeasures in response to cure for the imbalance. The novel procedure of applying DC imbalance remediation techniques advantageously breaks the unbalanced polarity pattern or beat pattern that may result in the charge accumulation running away.

In one embodiment, a method for driving a display panel having a variable refresh rate is disclosed. The method comprises receiving a current input frame from an image source. It also comprises determining a first number of re-scanned frames to insert between the current input frame and a subsequent input frame, wherein the re-scanned frames repeat the current input frame, and wherein the determining depends on a minimum refresh interval (MRI) of the display panel. Next, it comprises calculating respective intervals at which to insert the first number of re-scanned frames between the current input frame and the subsequent input frame. Further, it comprises scanning the current input frame for display on the display panel. Finally, it comprises inserting the first number of re-scanned frames at the respective intervals between the current input frame and the subsequent input frame from the image source, wherein the inserting is operable to reduce charge accumulation in the display panel.

In a different embodiment, a non-transitory computer-readable storage medium having stored thereon, computer executable instructions that, if executed by a computer system cause the computer system to perform a method for driving a display panel having a variable refresh rate is disclosed. The method comprises receiving a current input frame from an image source. It also comprises determining a first number of re-scanned frames to insert between the current input frame and a subsequent input frame, wherein the re-scanned frames repeat the current input frame, and wherein the determining depends on a minimum refresh interval (MRI) of the display panel. Next, it comprises calculating respective intervals at which to insert the first number of re-scanned frames between the current input frame and the subsequent input frame. Further, it comprises scanning the current input frame for display on the display panel. Finally, it comprises inserting the first number of re-scanned frames at the respective intervals between the current input frame and the subsequent input frame from the image source, wherein the inserting is operable to reduce charge accumulation in the display panel.

In a different embodiment, a system comprising a variable refresh rate display, a memory for storing images from an image source, and a processor coupled to the memory is disclosed. The processor is operable to implement a method for driving a display panel having a variable refresh rate. The method implemented by the processor comprises receiving a current input frame from an image source. It also comprises determining a first number of re-scanned frames to insert between the current input frame and a subsequent input frame, wherein the re-scanned frames repeat the current input frame, and wherein the determining depends on a minimum refresh interval (MRI) of the display panel. Next, it comprises calculating respective intervals at which to insert the first number of re-scanned frames between the current input frame and the subsequent input frame. Further, it comprises scanning the current input frame for display on the display panel. Finally, it comprises inserting the first number of re-scanned frames at the respective intervals between the current input frame and the subsequent input frame from the image source, wherein the inserting is operable to reduce charge accumulation in the display panel.

The following detailed description together with the accompanying drawings will provide a better understanding of the nature and advantages of the present invention.

BRIEF DESCRIPTION OF THE DRAWINGS

Embodiments of the present invention are illustrated by way of example, and not by way of limitation, in the figures of the accompanying drawings and in which like reference numerals refer to similar elements.

FIG. 8 illustrates the manner in which the DC imbalance avoidance procedure can prevent DC imbalance from occurring in accordance with an embodiment of the present invention.

FIG. 10 illustrates the manner in which a counter-measure can be employed in order to reverse an exemplary polarity pattern in accordance with an embodiment of the present invention.

FIG. 12A illustrates a first exemplary polarity history array in accordance with an embodiment of the present invention.

FIG. 12B illustrates a first exemplary polarity history array in accordance with an embodiment of the present invention.

DETAILED DESCRIPTION OF THE INVENTION

Figure 1:
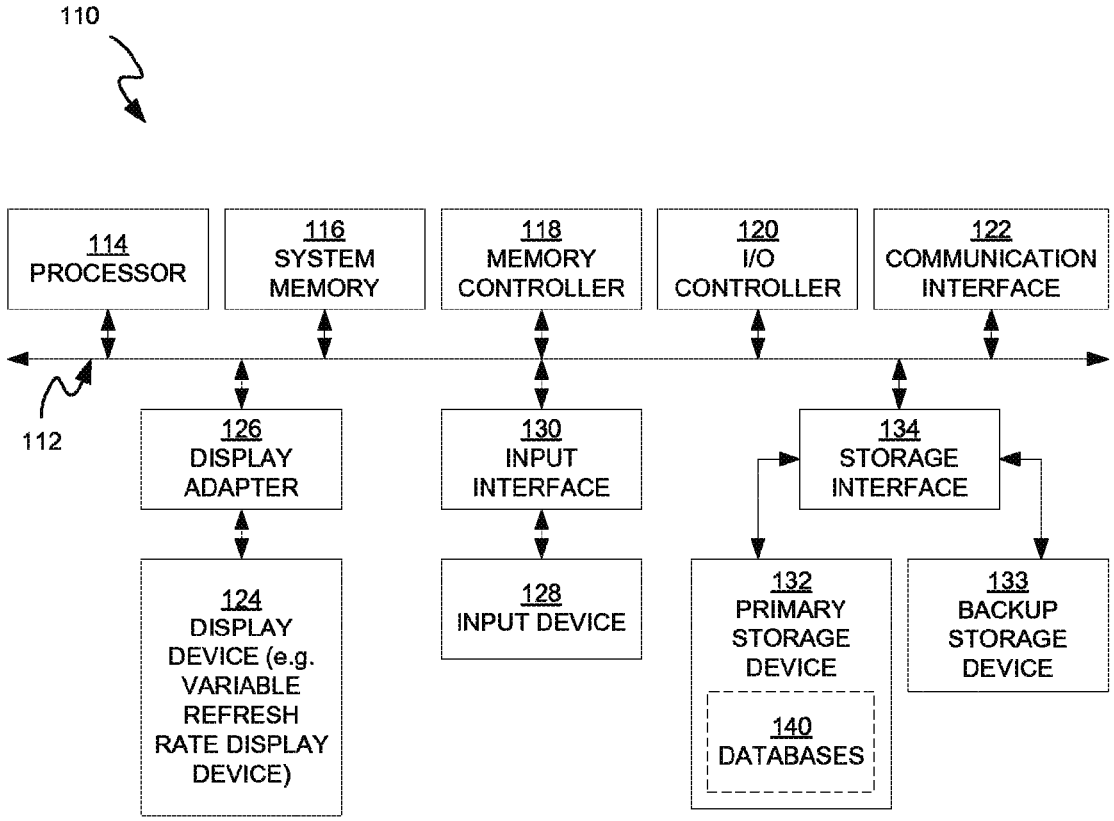
FIG. 1 is an exemplary computer system in accordance with embodiments of the present invention.

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Some portions of the detailed descriptions that follow are presented in terms of procedures, logic blocks, processing, and other symbolic representations of operations on data bits within a computer memory. These descriptions and representations are the means used by those skilled in the data processing arts to most effectively convey the substance of their work to others skilled in the art. In the present application, a procedure, logic block, process, or the like, is conceived to be a self-consistent sequence of steps or instructions leading to a desired result. The steps are those utilizing physical manipulations of physical quantities. Usually, although not necessarily, these quantities take the form of electrical or magnetic signals capable of being stored, transferred, combined, compared, and otherwise manipulated in a computer system. It has proven convenient at times, principally for reasons of common usage, to refer to these signals as transactions, bits, values, elements, symbols, characters, samples, pixels, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present disclosure, discussions utilizing terms such as "inserting," "receiving," "calculating," "determining," or the like, refer to actions and processes (e.g., flowchart 700 of FIG. 7) of a computer system or similar electronic computing device or processor (e.g., system 110 of FIG. 1). The computer system or similar electronic computing device manipulates and transforms data represented as physical (electronic) quantities within the computer system memories, registers or other such information storage, transmission or display devices.

Embodiments described herein may be discussed in the general context of computer-executable instructions residing on some form of computer-readable storage medium, such as program modules, executed by one or more computers or other devices. By way of example, and not limitation, computer-readable storage media may comprise non-transitory computer-readable storage media and communication media; non-transitory computer-readable media include all computer-readable media except for a transitory, propagating signal. Generally, program modules include routines, programs, objects, components, data structures, etc., that perform particular tasks or implement particular abstract data types. The functionality of the program modules may be combined or distributed as desired in various embodiments.

Computer storage media includes volatile and nonvolatile, removable and non-removable media implemented in any method or technology for storage of information such as computer-readable instructions, data structures, program modules or other data. Computer storage media includes, but is not limited to, random access memory (RAM), read only memory (ROM), electrically erasable programmable ROM (EEPROM), flash memory or other memory technology, compact disk ROM (CD-ROM), digital versatile disks (DVDs) or other optical storage, magnetic cassettes, magnetic tape, magnetic disk storage or other magnetic storage devices, or any other medium that can be used to store the desired information and that can accessed to retrieve that information.

Communication media can embody computer-executable instructions, data structures, and program modules, and includes any information delivery media. By way of example, and not limitation, communication media includes wired media such as a wired network or direct-wired connection, and wireless media such as acoustic, radio frequency (RF), infrared, and other wireless media. Combinations of any of the above can also be included within the scope of computer-readable media.

FIG. 1 is a block diagram of an example of a computing system 110 capable of implementing embodiments of the present disclosure. Computing system 110 broadly represents any single or multi-processor computing device or system capable of executing computer-readable instructions. Examples of computing system 110 include, without limitation, workstations, laptops, client-side terminals, servers, distributed computing systems, handheld devices, gaming systems, variable refresh rate display systems, or any other computing system or device. In its most basic configuration, computing system 110 may include at least one processor 114 and a system memory 116.

Processor 114 generally represents any type or form of processing unit capable of processing data or interpreting and executing instructions. For example, processing unit 114 may represent a central processing unit (CPU), a graphics processing unit (GPU), or both. In one embodiment, the DC imbalance detection and DC imbalance remediation procedure of the present invention is programmed into either the CPU (or GPU) 114. In certain embodiments, processor 114 may receive instructions from a software application or module. These instructions may cause processor 114 to perform the functions of one or more of the example embodiments described and/or illustrated herein.

System memory 116 generally represents any type or form of volatile or non-volatile storage device or medium capable of storing data and/or other computer-readable instructions. Examples of system memory 116 include, without limitation, RAM, ROM, flash memory, or any other suitable memory device. Although not required, in certain embodiments computing system 110 may include both a volatile memory unit (such as, for example, system memory 116) and a non-volatile storage device (such as, for example, primary storage device 132).

Computing system 110 may also include one or more components or elements in addition to processor 114 and system memory 116. For example, in the embodiment of FIG. 1, computing system 110 includes a memory controller 118, an input/output (I/O) controller 120, and a communication interface 122, each of which may be interconnected via a communication infrastructure 112. Communication infrastructure 112 generally represents any type or form of infrastructure capable of facilitating communication between one or more components of a computing device. Examples of communication infrastructure 112 include, without limitation, a communication bus (such as an Industry Standard Architecture (ISA), Peripheral Component Interconnect (PCI), PCI Express (PCIe), or similar bus) and a network.

Memory controller 118 generally represents any type or form of device capable of handling memory or data or controlling communication between one or more components of computing system 110. For example, memory controller 118 may control communication between processor 114, system memory 116, and I/O controller 120 via communication infrastructure 112.

I/O controller 120 generally represents any type or form of module capable of coordinating and/or controlling the input and output functions of a computing device. For example, I/O controller 120 may control or facilitate transfer of data between one or more elements of computing system 110, such as processor 114, system memory 116, communication interface 122, display adapter 126, input interface 130, and storage interface 134.

Communication interface 122 broadly represents any type or form of communication device or adapter capable of facilitating communication between example computing system 110 and one or more additional devices. For example, communication interface 122 may facilitate communication between computing system 110 and a private or public network including additional computing systems. Examples of communication interface 122 include, without limitation, a wired network interface (such as a network interface card), a wireless network interface (such as a wireless network interface card), a modem, and any other suitable interface. In one embodiment, communication interface 122 provides a direct connection to a remote server via a direct link to a network, such as the Internet. Communication interface 122 may also indirectly provide such a connection through any other suitable connection.

Communication interface 122 may also represent a host adapter configured to facilitate communication between computing system 110 and one or more additional network or storage devices via an external bus or communications channel. Examples of host adapters include, without limitation, Small Computer System Interface (SCSI) host adapters, Universal Serial Bus (USB) host adapters, IEEE (Institute of Electrical and Electronics Engineers) 1394 host adapters, Serial Advanced Technology Attachment (SATA) and External SATA (eSATA) host adapters, Advanced Technology Attachment (ATA) and Parallel ATA (PATA) host adapters, Fibre Channel interface adapters, Ethernet adapters, or the like. Communication interface 122 may also allow computing system 110 to engage in distributed or remote computing. For example, communication interface 122 may receive instructions from a remote device or send instructions to a remote device for execution.

As illustrated in FIG. 1, computing system 110 may also include at least one display device 124, e.g., a variable refresh rate display device coupled to communication infrastructure 112 via a display adapter 126. Display device 124 generally represents any type or form of device capable of visually displaying information forwarded by display adapter 126. Similarly, display adapter 126 generally represents any type or form of device configured to forward graphics, text, and other data for display on display device 124. In one embodiment, display device 124 may be an LCD device with a variable refresh rate. In one embodiment, the DC imbalance avoidance, DC imbalance detection and DC imbalance remediation procedure of the present invention is programmed into firmware of display device 124 or display adapter 126. Because the DC imbalance avoidance, detection and remediation procedures will typically be tailored to a respective LCD system, in a preferred embodiment, the procedures will be programmed directly into the firmware of the display device 124 or display adapter 126. For example, the procedures may be directly programmed in a programmable processor or fixed function dedicated hardware in either display device 124 or display adapter 126.

As illustrated in FIG. 1, computing system 110 may also include at least one input device 128 coupled to communication infrastructure 112 via an input interface 130. Input device 128 generally represents any type or form of input device capable of providing input, either computer- or human-generated, to computing system 110. Examples of input device 128 include, without limitation, a keyboard, a pointing device, a speech recognition device, or any other input device.

As illustrated in FIG. 1, computing system 110 may also include a primary storage device 132 and a backup storage device 133 coupled to communication infrastructure 112 via a storage interface 134. Storage devices 132 and 133 generally represent any type or form of storage device or medium capable of storing data and/or other computer-readable instructions. For example, storage devices 132 and 133 may be a magnetic disk drive (e.g., a so-called hard drive), a floppy disk drive, a magnetic tape drive, an optical disk drive, a flash drive, or the like. Storage interface 134 generally represents any type or form of interface or device for transferring data between storage devices 132 and 133 and other components of computing system 110.

In one example, databases 140 may be stored in primary storage device 132. Databases 140 may represent portions of a single database or computing device or it may represent multiple databases or computing devices. For example, databases 140 may represent (be stored on) a portion of computing system 110 and/or portions of example network architecture 200 in FIG. 2 (below). Alternatively, databases 140 may represent (be stored on) one or more physically separate devices capable of being accessed by a computing device, such as computing system 110 and/or portions of network architecture 200.

Continuing with reference to FIG. 1, storage devices 132 and 133 may be configured to read from and/or write to a removable storage unit configured to store computer software, data, or other computer-readable information. Examples of suitable removable storage units include, without limitation, a floppy disk, a magnetic tape, an optical disk, a flash memory device, or the like. Storage devices 132 and 133 may also include other similar structures or devices for allowing computer software, data, or other computer-readable instructions to be loaded into computing system 110. For example, storage devices 132 and 133 may be configured to read and write software, data, or other computer-readable information. Storage devices 132 and 133 may also be a part of computing system 110 or may be separate devices accessed through other interface systems.

Many other devices or subsystems may be connected to computing system 110. Conversely, all of the components and devices illustrated in FIG. 1 need not be present to practice the embodiments described herein. The devices and subsystems referenced above may also be interconnected in different ways from that shown in FIG. 1. Computing system 110 may also employ any number of software, firmware, and/or hardware configurations. For example, the example embodiments disclosed herein may be encoded as a computer program (also referred to as computer software, software applications, computer-readable instructions, or computer control logic) on a computer-readable medium.

The computer-readable medium containing the computer program may be loaded into computing system 110. All or a portion of the computer program stored on the computer-readable medium may then be stored in system memory 116 and/or various portions of storage devices 132 and 133. When executed by processor 114, a computer program loaded into computing system 110 may cause processor 114 to perform and/or be a means for performing the functions of the example embodiments described and/or illustrated herein. Additionally or alternatively, the example embodiments described and/or illustrated herein may be implemented in firmware and/or hardware.

For example, a computer program for tracking and remedying DC imbalance may be stored on the computer-readable medium and then stored in system memory 116 and/or various portions of storage devices 132 and 133. When executed by the processor 114, the computer program may cause the processor 114 to perform and/or be a means for performing the functions required for carrying out DC imbalance avoidance, detection and remediation discussed above.

Techniques for Avoiding and Remedying Dc Bias Buildup on a Flat Panel Variable Refresh Rate Display Embodiments of the present invention provide a method and apparatus to prevent charge accumulation within the component dots of pixels in a variable refresh rate display. Embodiments of the present invention provide a method for avoiding charge accumulation and resultant visual artifacts by intelligently inserting repeat frames between input frames provided by a graphics processing unit (GPU) to a LCD monitor.

Embodiments of the present invention provide a method for preventing charge accumulation and resultant visual artifacts by dynamically analyzing a sequence of frames to detect any DC imbalance building up within the pixels of the LCD panel and performing a sequence of remediation procedures in response to cure for the imbalance. The novel procedure of applying DC imbalance remediation techniques advantageously breaks the unbalanced polarity pattern or beat pattern that may result in the charge running away.

In a conventional variable refresh rate display, successive frames will have roughly the same duration and alternating the polarity between successive frames will typically work to prevent charge accumulation. However, there are some scenarios where this does not hold true. For example, image sources such as graphics processing units (GPUs) can have a tendency to get into an unbalanced polarity pattern or beat pattern where the arrival interval of incoming frames alternates between longer and shorter. For example, the beat pattern may be represented as the following: +/long, −/short, +/long, −/short, etc. This can result in a DC imbalance over time.

Another example where charge build-up can result is where an LCD panel has a minimum refresh rate (or maximum frame duration) below which the panel will start to show delay-related flicker. In the event that the GPU cannot keep up with the refresh rate, to combat this decay flicker, the driving electronics of the LCD panel or the GPU itself will repeat the prior frame to ensure that the refresh rate will not fall below this minimum threshold.

Figure 2:
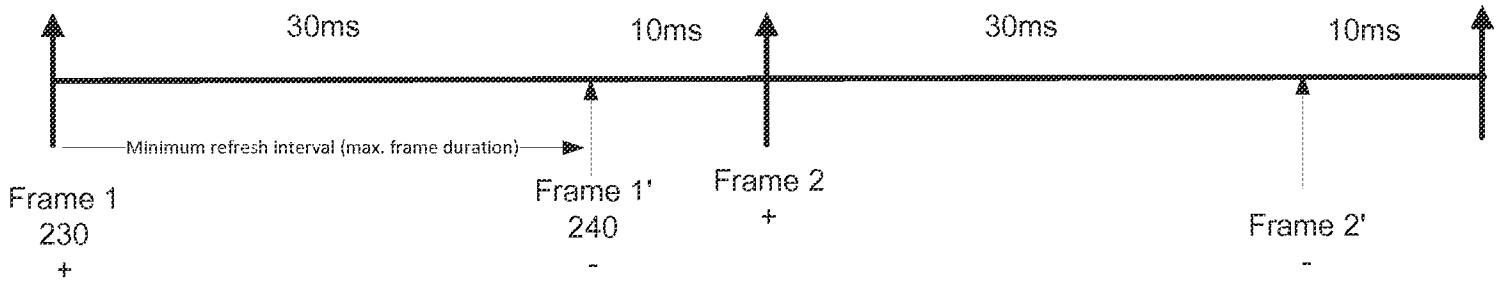
FIG. 2 illustrates the manner in which repeating a prior frame to ensure that the refresh rate will not fall below a minimum threshold can result in a DC imbalance.

FIG. 2 illustrates the manner in which repeating a prior frame to ensure that the refresh rate will not fall below a minimum threshold can result in a DC imbalance. FIG. 2 illustrates a scenario wherein the maximum frame duration of an LCD panel (also known as the "minimum refresh interval") is set at 30 ms and frames are sent to the display from the GPU (or CPU) at a rate of 40 ms. When the 30 ms is reached, the panel will repeat the prior frame, but 10 ms after repeating the prior frame, the LCD will receive the new frame. The table in FIG. 2 illustrates the manner in which a DC imbalance will result in this situation. When the 30 ms threshold is reached, Frame 1 230, having a positive polarity, is repeated as Frame 1' 240 for an additional 10 ms, wherein Frame 1' 240 has a negative polarity. If this unbalanced polarity pattern continues as shown in the table of FIG. 2, a DC imbalance will result over time. The DC imbalance results in visual artifacts such as flicker that distort the user's experience.

Embodiments of the present invention provide a method and apparatus to combat this DC imbalance, either by avoiding it completely or by remedying it when it occurs. In one embodiment, the present invention first tries to avoid DC imbalance altogether by intelligently re-scanning frames at equi-distant intervals in between input frames from the GPU. Stated differently, incoming frames from the GPU are repeated and inserted at equi-distant intervals in between the incoming frames. It should be noted that timing controllers (TCONS) within the LCD panel alternate polarity with every scan-out of a frame, whether a new frame or a repeated frame. The polarity of the frames typically cannot be directly controlled. Thus, the DC avoidance procedure, in one embodiment, controls when to repeat (or re-scan) some available frame. Accordingly, as will be explained in detail below, the avoidance mechanism works by strategically inserting re-scanned frames between input frames from the GPU.

In another embodiment, the present invention performs DC imbalance monitoring and detection. If a DC imbalance exceeds a predetermined threshold, a sequence of remediation procedures, which will be explained in detail below, is applied to restore the DC balance. For example, the sequence, in one embodiment, first tries to reduce the number of inserted re-scanned frames to try and invert the polarity pattern. It may also try to drop a frame entirely. In one embodiment, the sequence of remediation procedures may also try to add another re-scanned frame in order to invert the polarity pattern.

As mentioned above, in one embodiment, the DC imbalance detection and DC imbalance remediation procedures of the present invention can be programmed into the GPU, which is in constant communication with the LCD. In a different embodiment, the detection and remediation procedures can be programmed directly into the firmware of the LCD display. It should be noted that in a typical embodiment the DC imbalance detection and remediation are performed collectively for all pixels of the LCD screen. However, in one embodiment, the detection and correction can be performed on a per-pixel basis, however, this embodiment would typically require additional computation power and is less efficient than performing detection and remediation for all pixels collectively.

DC Model

Figure 3:
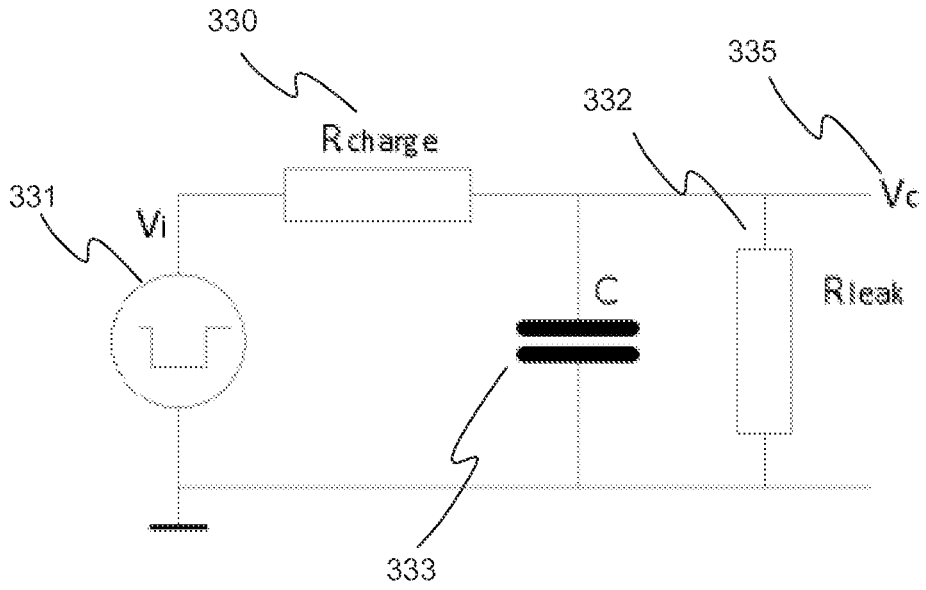
FIG. 3 illustrates the manner in which DC balance on a LCD panel is modeled using an exemplary RC network in accordance with one embodiment of the present invention.

FIG. 3 illustrates the manner in which DC balance on a LCD panel is modeled using an exemplary RC network in accordance with one embodiment of the present invention. It should be noted that the DC balance on a LCD panel can also be modeled using other techniques that do not use a RC network.

Input Vi 331 represents the driving voltage supplied to a pixel in the panel. Resistor 330 and capacitor 333 together model how fast the pixel will charge and build up voltage, wherein the values of resistor Rcharge 330 and capacitor 333 dictate the value of the RC time constant of the charge/discharge circuit. The charge/discharge time constant, A, can be calculated as follows:

$$A=C*R\text{charge} \quad \text{(Eq. 1)}$$

Meanwhile, Rleak 332 and capacitor 333 together model how fast the pixel will leak voltage, wherein the values of Rleak 332 and capacitor 333 dictate the value of the RC time constant of the leakage circuit. The leak time constant, B, can be calculated as follows:

$$B=C*R\text{leak} \quad \text{(Eq. 2)}$$

The input voltage, Vi 331, is assumed to alternate every frame between −K and +K volts. In one embodiment, in order to track the DC bias, the built-up charge voltage, Vc 335, may be expressed as a fraction of the input amplitude, in which case, the value K itself is not relevant. Accordingly, K can simply be set to the value of 1.

Over a short time period "dt", which is much smaller than the time constants, A and B, the value of Vc 335 can be approximated using the following linear equation:

$$Vc(t+dt)=Vc(t)*(1-dt/B)+(Vi-Vc(t))*dt/A \quad \text{(Eq. 3)}$$

In one embodiment, to evaluate how Vc 335 changes over longer time intervals, the long interval can be partitioned into multiple smaller consecutive intervals, and the above formula, Equation 3, can be repeatedly applied to each of those.

The goal of DC balancing is to prevent |Vc| from exceeding some threshold. If, however, |Vc| does exceed the threshold value, the goal of DC balancing is to detect it and to average Vc around zero.

In a typical embodiment, Equation 3 is used to model the pixels of the LCD panel collectively. A separate calculation is typically not performed for each pixel.

I. A. DC Imbalance Avoidance

In order to avoid delay flicker (at the scan rate), a minimum refresh rate must be maintained as discussed in relation with FIG. 2. The time interval associated with this is called Minimum Refresh Interval (or MRI). For example, the panel discussed in FIG. 2 has a minimum refresh interval of 30 ms. Accordingly, the time between the start of two consecutive scan-outs typically cannot exceed the MRI, unless specifically allowed by the DC imbalance avoidance procedure under special circumstances. Referring back, FIG. 2 illustrates a case where the MRI is 30 ms, however, frames are being sent to the LCD panel from the GPU (or CPU) at the rate of 40 ms. Thus, a scan-out is necessary either at the MRI of 30 ms or before. If a frame is repeated at the MRI of 30 ms, a DC imbalance results as shown in FIG. 2.

In one embodiment, the present invention attempts to avoid DC imbalance altogether by intelligently re-scanning frames at equi-distant intervals in between input frames from the GPU. For example, the DC imbalance of FIG. 2 could be avoided by inserting the re-scanned frames halfway in between the input frames from the GPU instead of at the end of the MRI.

Figure 4:
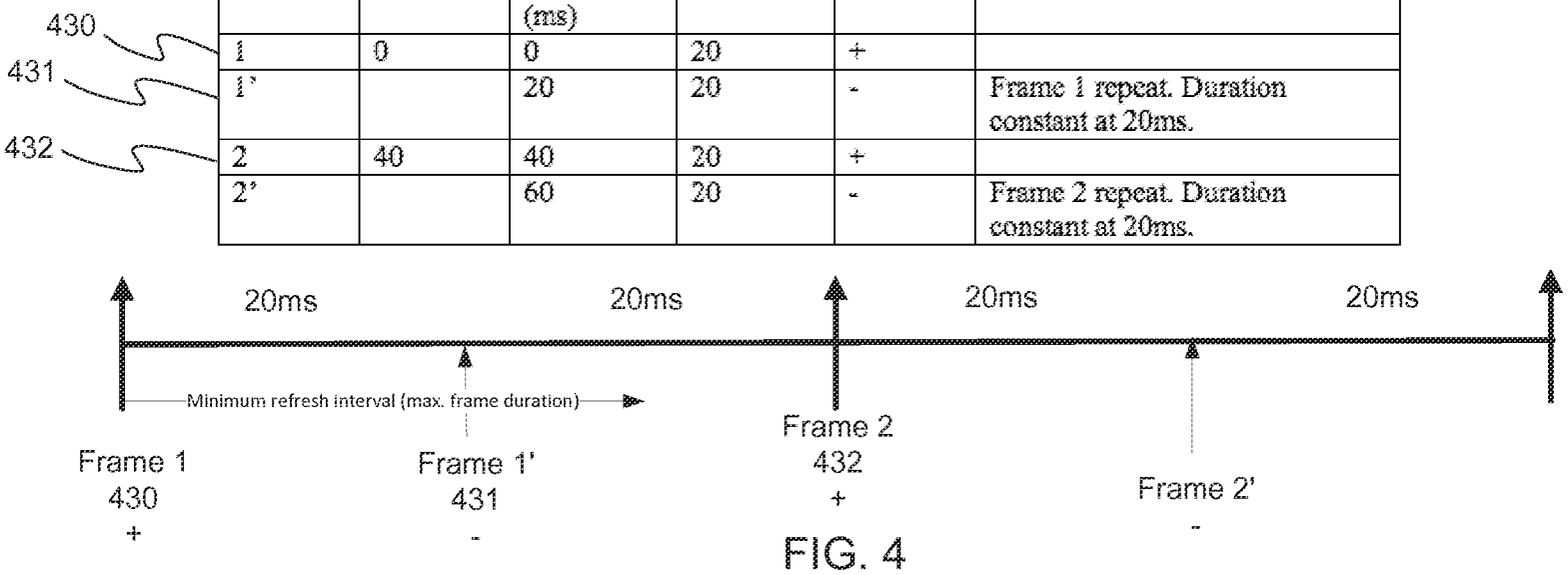
FIG. 4 illustrates the manner in which a repeated frame can be spaced evenly between a prior and a subsequent frame in accordance with embodiments of the invention.

FIG. 4 illustrates the manner in which a repeated frame can be spaced evenly between a prior and a subsequent frame in accordance with embodiments of the invention. Inserted Frame 1' 431 is evenly spaced between prior frame, Frame 1 430, and the next frame, Frame 2 432. By positioning the repeated frame right in the middle, this DC imbalance can be avoided entirely. The DC imbalance avoidance procedure is especially useful for panels that have a minimum refresh interval. Further, the DC imbalance avoidance procedure is most effective with panels that are being refreshed by the image source, e.g., a GPU at a low rate.

In one embodiment, the avoidance procedure can compute the location to add the re-scanned frame by predicting the duration of the current frame on the basis of the duration of the prior frame. In other words, the DC imbalance procedure treats the duration of the input frames as highly correlated and, accordingly, uses the length of a prior frame as a prediction for the duration of the current frame. Because the frame prior to Frame 1 430 in FIG. 4 was likely 40 ms, the procedure is able to compute that a re-scan should be inserted 20 ms after the arrival of an input frame from the GPU. However, in a different embodiment, the duration of the current frame may be computed and transmitted ahead of time to the LCD from the GPU.

By way of example, if only a single frame is repeated as in FIG. 4, it can be inserted in the middle of the previous frame and the following frame. By way of further example, in the case of two repeated frames, the first frame may be spaced ⅓ of the way from the previous frame and the second frame may be spaced ⅔ of the way from the previous frame. By equally spacing out the repeated frame, the avoidance procedure can ensure an average DC balance of near zero.

A typical example of this embodiment would be a video source that plays a movie at a constant 24 frames per second (fps), below the minimum refresh rate of 30 fps of a panel. By inserting the repeated frames evenly, the refresh rate can be up converted to 48 fps or 72 fps, while keeping the DC balance constant.

It should be noted that the efficacy of the avoidance procedure may be influenced by the correlation of the image content; for example, the procedure may be more effective when image content is highly correlated in terms of temporal variation in pixels.

When discussing the DC imbalance avoidance technique, it is also important to distinguish input frames (provided by the GPU as input to the LCD monitor) from output frames (painted or "scanned out" by the logic circuitry inside the monitor onto the actual LCD panel). As such, input frame parameters, e.g., start time, duration etc. can be distinguished from output frame parameters.

In one embodiment, it is possible for the avoidance procedure to scan out the same input frame to the LCD panel multiple times, e.g., for MRI compliance. It would also be possible, in one embodiment, for the procedure to drop an input frame or never scan it out. The first time that any given input frame is scanned out is called the "first scan-out" of that input frame. Accordingly, if no frames are dropped, then each input frame has one associated first scan-out at least. The first scan-out may begin immediately upon start of the input frame's arrival or with any delay thereafter. In other words the first scan-out may begin before the input frame has fully arrived or it may start after some delay subsequent to arrival. The first scan-out, however, cannot complete until the input frame has fully arrived.

If the scan-outs of the frames are all of near identical duration as in the example of FIG. 4, then the DC balance will be near zero. This matches the normal use case of standard monitors with fixed refresh rates. With embodiments of the present invention, this can be achieved by inserting the re-scans that are needed to maintain the MRI at equi-distant intervals, using the prior frames duration as an estimate for the current frame.

When a re-scan is inserted, it is possible that the GPU may begin to send a new frame to the monitor while the re-scan is in progress. This is referred to as a temporal collision. Typically, a variable refresh rate display of the present invention that is synced to the image source, e.g., a GPU, will need to scan-out (or "paint") the new input frame right away. However, in the event of a temporal collision, because a scan-out has already started, it must be completed before the incoming frame is presented on the LCD screen. As a result, the first scan-out of the new input frame, in one embodiment, is delayed until the current re-scan of the prior input frame is completed. The amount of delay incurred as a result of this is referred to as the "push-out" of the input frame.

In one embodiment, the DC imbalance avoidance procedure attempts to insert an even number of re-scans in between input frames. As will be illustrated using the examples from FIGS. 5A-6, the rationale underlying preferring an even count is that it ensures that all first scan-outs have alternating polarities, which will balance DC even if the re-scans are not equi-distant. In one embodiment, the procedure attempts to space the inserted frames equi-distant steps in time during the interval until the predicted arrival of the next input frame. As will be shown in reference to FIG. 5B, this embodiment is useful in circumstances where an odd number of frames need to be inserted in between input frames because it keeps the DC balance in check.

Figure 5A:
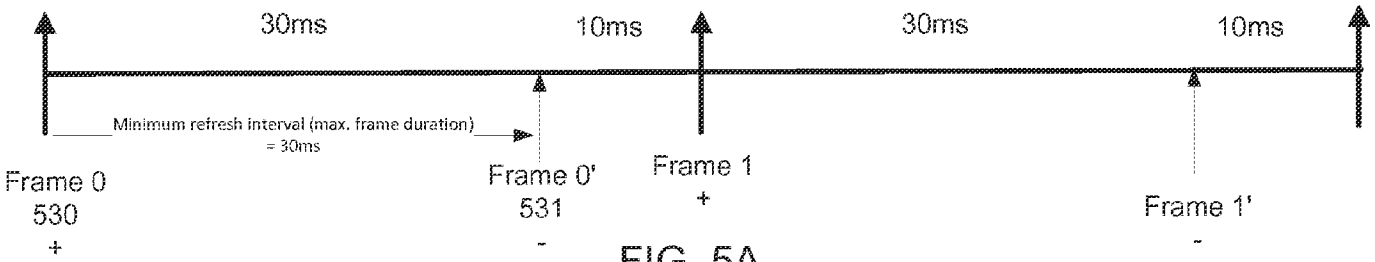
FIG. 5A illustrates the manner in which a DC imbalance can build up as a resulting of inserting an odd number of frames where the resulting output frame durations are not the same.

FIG. 5A illustrates the manner in which a DC imbalance can build up as a resulting of inserting an odd number of frames where the resulting output frame durations are not the same. As shown in FIG. 5A, the first scan-out of the frame 530, having a positive polarity, stays on the screen for a duration of 30 ms, while the re-scan 531, having a negative polarity, stays on-screen for only 10 ms. Because the output frame durations are not the same and an odd number of frames are inserted, a DC imbalance results.

Figure 5B:
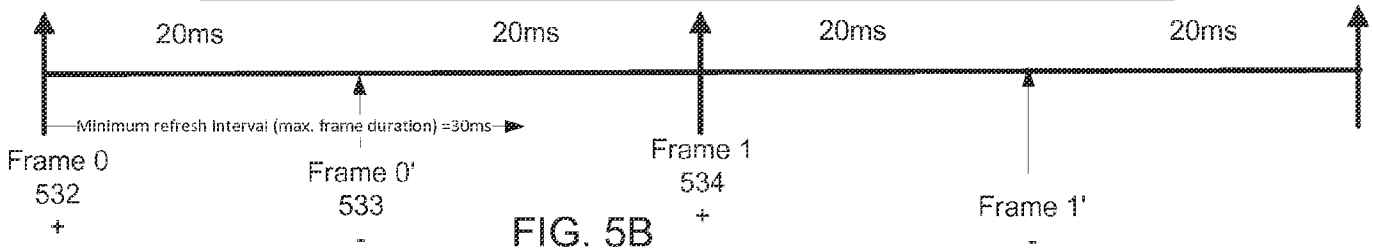
FIG. 5B illustrates the manner in which DC imbalance is prevented by inserting an odd number of frames at equidistant intervals between incoming frames in accordance with an embodiment of the present invention.

FIG. 5B illustrates the manner in which DC imbalance is prevented by inserting an odd number of frames at equi-distant intervals between incoming frames in accordance with an embodiment of the present invention. In one embodiment, an odd number of frames may need to be inserted in between incoming frames. In such cases, inserting the re-scans at equi-distant intervals between the incoming frames can prevent a DC imbalance. For example, the re-scan 533 shown in FIG. 5B is inserted between input frames (or first scan-outs) 532 and 534. Because the output frame durations are identical, a DC imbalance is prevented.

Figure 6:
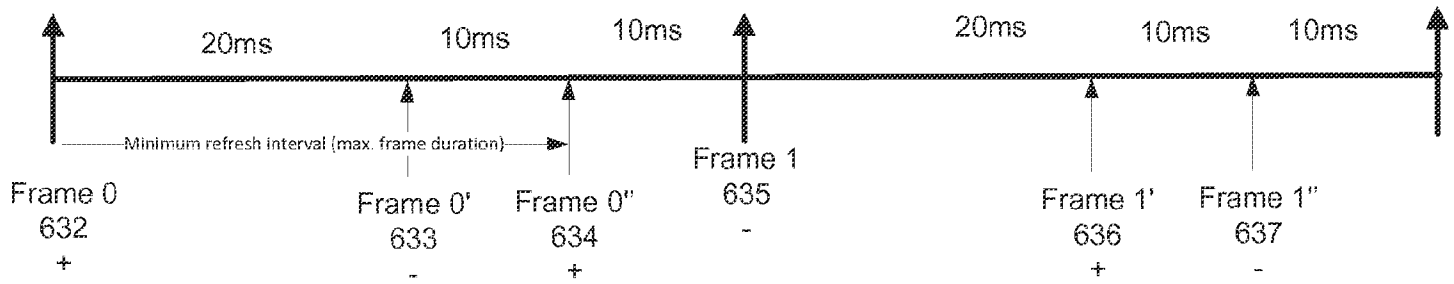
FIG. 6 illustrates the manner in which DC imbalance is prevented by inserting an even number of re-scans in between input frames even where the output frame durations are not the same in accordance with one embodiment of the present invention.

FIG. 6 illustrates the manner in which DC imbalance is prevented by inserting an even number of re-scans in between input frames even where the output frame durations are not the same in accordance with one embodiment of the present invention. In the example illustrated in FIG. 6, two re-scans 633 and 634 are inserted in between first scan-outs 632 and 635. The re-scans are not inserted at equi-distant intervals between the first scan-outs. Re-scan 633 occurs 20 ms after the first-scan out 632 and re-scan 634 occurs only 10 ms after re-scan 633. Nevertheless, because an even number of rescans is inserted between the two input frames, DC imbalance is prevented, because the polarity sequence will invert for every input frame. For example, input frame 1 635 has a negative polarity as compared with input frame 0 632. The two re-scans subsequent to input frame 1 635 also have reversed polarities as compared to their corresponding earlier counterparts. Re-scan 636 has a different polarity than re-scan 633 while re-scan 637 has a different polarity than re-scan 634. Accordingly, the DC bias stays in balance when an even number of re-scans are inserted between input frames.

I. B. Implementation of the DC Imbalance Avoidance Procedure

Figure 7:
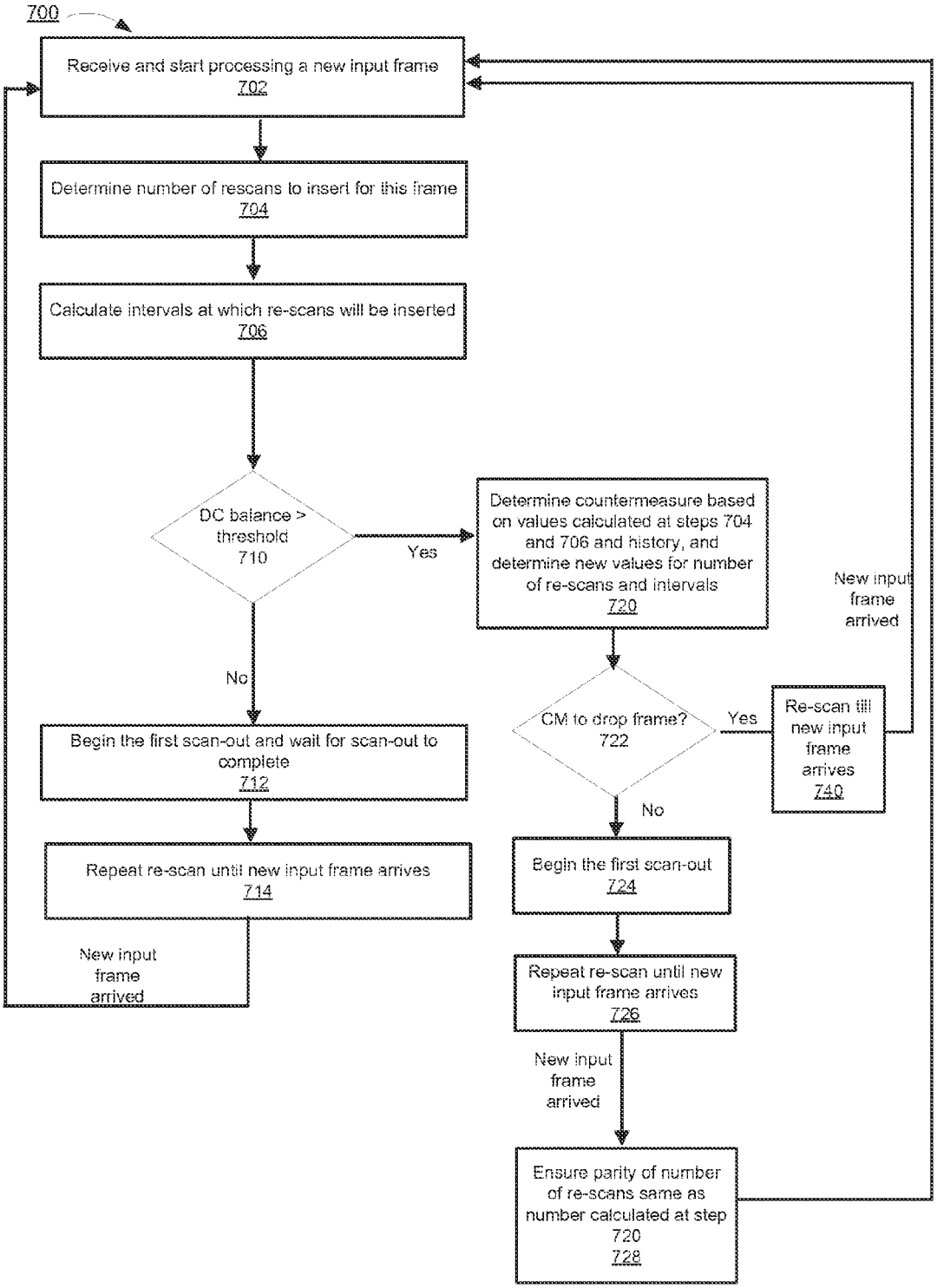
FIG. 7 shows a flowchart of an exemplary computer-implemented process of implementing a DC imbalance avoidance procedure for variable refresh rate display in accordance with embodiments of the present invention.

FIG. 7 shows a flowchart 700 of an exemplary computer-implemented process of implementing a DC imbalance avoidance procedure for variable refresh rate display in accordance with embodiments of the present invention. While the various steps in this flowchart are presented and described sequentially, one of ordinary skill will appreciate that some or all of the steps can be executed in different orders and some or all of the steps can be executed in parallel. Further, in one or more embodiments of the invention, one or more of the steps described below can be omitted, repeated, and/or performed in a different order. Accordingly, the specific arrangement of steps shown in FIG. 7 should not be construed as limiting the scope of the invention. Rather, it will be apparent to persons skilled in the relevant art(s) from the teachings provided herein that other functional flows are within the scope and spirit of the present invention. Flowchart 700 may be described with continued reference to exemplary embodiments described above, though the method is not limited to those embodiments.

At step 702, a new input frame is received from the GPU, for example, and the LCD circuitry starts processing it. At step 704, the DC imbalance avoidance procedure determines the number of re-scans that need to be inserted for this new input frame.

The minimum number of re-scans that can be inserted for the new frame depends on the MRI. The maximum number of re-scans that can be inserted is determined by the number of times the frame can be re-scanned after the first scan-out before the next frame is predicted to arrive. In one embodiment, these computations are performed based on the duration of the prior frame and the current frame's push-out. In one embodiment, the procedure chooses the lowest possible value. However, if the value chosen is odd and there is room in the frame to increase it to an even value without pushing out the next frame, then the procedure will increase the value by one. In other words, the procedure, in one embodiment, can be programmed to choose the lowest even value.

In one embodiment, the procedure can be programmed to take the amount of push-out for the current input frame into account in determining the number of re-scans to be inserted into the frame. As was discussed earlier, a push-out can result from insertion of re-scans in a prior frame that produces a temporal collision.

At step 706, the procedure calculates the interval at which re-scans will be inserted using the number of re-scans determined at step 704. If the procedure determines that an N number of re-scans should be inserted at step 704, then the calculated interval will be used at most N times. If, however, the current input frame's duration is longer than expected (or longer than the prior frame), then any further re-scans following the initial N re-scans will be done at an interval size of MRI.

At step 710, the procedure checks the DC balance threshold. In one embodiment, the DC balance is tracked using the RC model described above. In one embodiment, if |Vc| is below a threshold level, then the first scan-out can proceed without interruption at step 712. Further, the procedure waits for the first scan-out to complete at step 712. At step 714, the procedure waits until the first time the input frame is due to be re-scanned or the arrival of the next input frame, whichever occurs sooner. It should be noted that because the computations of the number of re-scans and re-scan intervals are done, in one embodiment, based on an estimated frame size, it is possible for the next input frame to arrive before a scheduled re-scan is performed.

If the time when the first re-scan due to be performed is reached without any new input frame arriving, then a re-scan is initiated at that point and the procedure waits for it to complete. Similarly, if at that point no new input frame has started to arrive, the procedure repeats step 714. In other words, in one embodiment, the procedure waits (for the duration calculated at step 706) until the next re-scan is due to be performed and performs it if no new input frame comes in. Alternatively, if the scheduled number of re-scans has already been performed, then instead of waiting for the duration calculated at step 706, the interval size is modified to MRI. The rationale for modifying the interval size to MRI is that in order to minimize the probability of a temporal collision, the number of re-scans is minimized and, therefore, the re-scan interval is maximized. If the MRI expires prior to the arrival of the subsequent frame, it likely indicates that the avoidance procedure is not working and, thus, there is a possibility of DC imbalance building up. As will be explained later in connection with step 720, in such cases, a counter-measure can be employed.

Finally, when the new frame arrives, the procedure is repeated at step 702 with the new frame.

In one embodiment, if |Vc| reaches a magnitude that exceeds a predetermined threshold, a one-time special action (also called a counter measure) can be taken to attempt to get the DC balance to drift back in the opposite direction (towards zero) at step 720. In one embodiment, however, a counter measure will only be implemented if a predetermined amount of time has elapsed since a prior counter measure. Because the DC balance takes some duration of time to drift back towards zero after a counter measure is implemented, a new counter measure is not typically implemented until the prior counter measure has been tried for a predetermined amount of time. The rationale for waiting is to allow the taken counter measure to take effect and |Vc| to change value so as to lower it below the threshold. Because |Vc| may still be above the threshold on the next input frame, even though it is improving, without this delay, the process may trigger another counter measure that would counteract the result of the prior counter measure and could cause |Vc| to stray in an undesirable direction.

Counter-measures, in one embodiment, are determined based on the values calculated at steps 704 and 706 and also on the history of prior frames. The process for determining and implementing the appropriate counter-measures will be discussed in subsequent sections below. The result of implementing a counter-measure, in one embodiment, is a modified value for the number of re-scans and a new corresponding re-scan interval.

Further, in one embodiment, one of the counter-measures that can be implemented is dropping the current input frame. In accordance with this embodiment, a decision is made at step 722 concerning whether or not to drop the current input frame. If the conditions for dropping the current input frame were met, then the frame is dropped and the avoidance procedure starts anew with a fresh frame at step 702 after the new input frame arrives. However, if after dropping the current frame, the new input arrive does not arrive right away, then the procedure waits at step 740 and provides new re-scans to the panel at the MRI. In one embodiment, the re-scan can simply be a re-scan of the dropped frame. Alternatively, in a different embodiment the re-scan can use the prior frame. From a practical standpoint, a situation where a frame is dropped, but a new frame does not arrive right away will be rare. In one embodiment, for example, the condition for dropping a frame can include the expectation (based on frame duration) that the next frame will arrive before any re-scan is needed for MRI compliance.

At step 724, if the frame is not dropped, then the first scan-out can proceed without interruption. Further, the procedure, in one embodiment, waits for the first scan-out to complete at step 724. At step 726, the procedure waits until the first time the input frame is due to be re-scanned or the arrival of the next input frame, whichever occurs sooner. It should be noted that the values for the number of re-scans to insert and re-scan interval duration used are the updated values calculated at step 720. It should also be noted that because the computations of the number of re-scans and re-scan intervals are done, in one embodiment, based on an estimated frame size, it is possible for the next input frame to arrive before a scheduled re-scan is performed.

If the time when the first re-scan due to be performed is reached without any new input frame arriving, then a re-scan is initiated at that point and the procedure waits for it to complete. Similarly, if after the re-scan completes, no new input frame has started to arrive, the procedure repeats step 726. In other words, in one embodiment, the procedure waits (for the duration calculated at step 720) till the next re-scan is due to be performed and performs it if no new input frame comes in. If, however, the scheduled number of re-scans has already been performed, then instead of waiting for the duration calculated at step 720, the interval size is modified to MRI. As explained earlier, the rationale for modifying the interval size to MRI is that in order to minimize the probability of a temporal collision, the number of re-scans is minimized and, therefore, the re-scan interval is maximized.

As a result of the counter-measure determined at step 720, when the new input frame finally arrives, the avoidance procedure needs to perform one final action related to the counter-measure at step 728 before beginning the processing of a new input frame at step 702.

At step 728, the procedure checks to see if the actual number of re-scans performed at step 726 were even or odd. In one embodiment, the avoidance procedure forces the number of re-scans to be even if the originally calculated number of re-scans at step 720 were even. Similarly, it forces the number of re-scans to be odd if the originally calculated number of re-scans at step 720 was odd. In other words, even if the actual number of re-scans is potentially different from the number predetermined at step 720, the difference (or sum) must be an even number to avoid a polarity inversion from what was intended by the countermeasure decision.

Accordingly, in one embodiment, at step 728, the procedure checks to see if the difference (or sum) of the total number of re-scans inserted at step 726 and the number of re-scans originally calculated at step 720 is an odd number. If it is an odd number, then another re-scan is started immediately. After waiting for the re-scan to complete, the next input frame can be processed at step 702. If the difference (or sum) ends up being an even number, then no re-scans are needed and the processing of the next input frame at step 702 can commence immediately. For example, if step 720 calculates the number of re-scans to be 3, however, at step 728, the procedure determines that only 1 re-scan was performed, no further re-scans need to be added because both numbers are odd. In other words, the difference (or sum) of the calculated number of re-scans (3) and the number of re-scans actually performed (1) is even.

FIG. 8 illustrates the manner in which the DC imbalance avoidance procedure can prevent DC imbalance from occurring in accordance with an embodiment of the present invention. In the example illustrated in FIG. 8, frames arrive at the LCD panel on average once every 50 ms from the image source, e.g., GPU and the MRI is 30 ms. Further, it takes 8 ms to transmit a frame from the image source to the monitor and to perform a re-scan inside the monitor.

The minimum number of re-scans as mentioned above depends on the MRI. Accordingly, since the MRI is 30 ms the minimum number of re-scans is 1. The first scan-out should be re-scanned, at the latest, by the 30 ms mark. The maximum number of re-scans, as mentioned earlier, is determined by the number of times the frame can be re-scanned after the first scan-out before the next frame is predicted to arrive. The maximum number of re-scans, without potentially delaying the next incoming frame, can be calculated using the amount of push-out of the current frame (start delay due to collision, zero in this case). Accordingly, the maximum number of re-scans is $(50-(0+8))/8=5$, where the amount of push-out (zero) and the amount of time it takes to perform the first scan-out (8 ms) is subtracted from the frame duration (50 ms) before computing the number of scan-outs that would fit into the 50 ms duration.

In one embodiment, the procedure will give a preference to the lowest even number calculated and, therefore, the procedure chooses to insert the maximum number of re-scans, which is 2, given the predicted duration of the current input frame. In one embodiment, the re-scans, as calculated at step 706, are computed as taking place at the following time interval: $50/(2+1)=16.7$ ms. Accordingly, for input frame 0 832, the first re-scan 833 will occur at 16.7 ms and the second re-scan 834 will occur at 33.3 ms. Because re-scans take 8 ms as noted above, the second re-scan 834 finishes at 41.3 ms, which indicates that there is no collision with the next input frame 835 if it arrives at the estimate time of 50 ms.

As shown in FIG. 8, the avoidance scheme advantageously uses an even number of equi-distant scans of the input frame to prevent DC build-up. If the avoidance scheme succeeds, then the DC build-up will not cross over the threshold value because the DC bias will always average close to zero.

However, occasionally DC will build up and $|Vc|$ may exceed the predetermined threshold, for example, if the frame ends up being a different size than the estimated duration. If DC balance does build up, a counter-measure can typically be employed, in one embodiment, for example, at step 720 in FIG. 7. The counter-measure, for example, could be to enforce just enforce 1 re-scan or 3 re-scans (instead of 2) for one of the input frames only. This will cause the DC to start drifting in the opposite direction since it will invert the polarity of all subsequent scan-out frames as compared to what the polarity of the frames would have been without the counter-measure.

In one embodiment, the DC balance is tracked at regular intervals in order to determine if the DC bias has drifted above a critical threshold and whether a counter-measure should be employed, e.g., at step 710. In one embodiment, the DC balance is updated at a predetermined granularity to track the effectiveness of the decisions made during the application of the procedure illustrated in FIG. 7. In one embodiment, the balance should be calculated at the start of each new scan-out since that is the point where the TCON will begin setting pixels to an inverted polarity. In one embodiment, the DC balance can be updated at a predetermined granularity between the starts of scan-outs, e.g., once every 2 ms, for improved accuracy. In a different embodiment, it may be sufficient to update DC balance once in a single step during the entire duration between scan-outs (considering that MRI is typically smaller than the RC time constants).

II. A. Counter-Measures

As explained in connection with step 710, the avoidance procedure in FIG. 7 calls for a counter-measure when the DC imbalance builds up to a value that exceeds a predetermined threshold. For example, DC imbalance could build up if the number of computed re-scans cannot be accomplished because of unexpected changes in frame duration, especially if the duration changes repeatedly, or if the re-scans cannot be placed at equi-distant intervals between incoming frames.

When the DC imbalance exceeds the threshold value, it typically indicates that the measures taken at steps 704, 706, 712, and 714 in FIG. 7 are not working. Thus, a counter-measure is taken at step 720, as a single time decision, to try and get the DC bias to reverse course. In other words, the counter-measure is not an action that is scheduled at regular intervals. Any particular counter-measure is typically employed once. However, if a counter-measure does not work, then the same or a different counter-measure can be applied after a given time interval to the same pattern. The counter-measure is targeted towards a polarity reversal for the remainder of the frame pattern which would cause the DC balance to start drifting in the opposite direction towards an average of zero.

Figure 9:
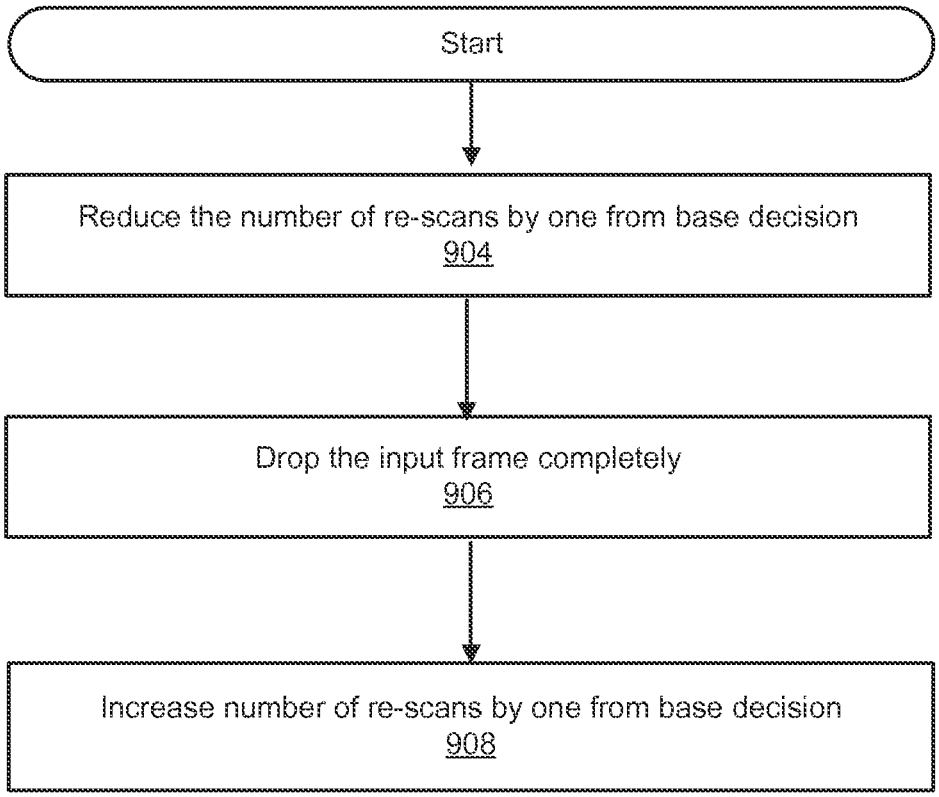
FIG. 9 shows a flowchart of an exemplary computer-implemented process of implementing a series of counter-measures to remediate DC bias build-up in a variable refresh rate display in accordance with embodiments of the present invention.

In one embodiment, the counter-measure creates a reversal by attempting to produce one less or one extra output frame (as compared with the standard decision taken at steps 704 and 706) within the duration of the current frame and before the first scan-out of the next input frame. It should also be noted that as a result of step 728, the even or odd nature of the number of re-scans determined as part of the counter-measure at step 720 is enforced regardless of input arrival time of the next frame. In other words, even if the current frame's duration is longer or shorter than expected, the action taken at step 728 will enforce that the total number of re-scans is even if the number of re-scans determined as part of the counter-measure at step 720 is even. Similarly, the action taken at step 728 will enforce that the total number of re-scans is odd if the number of re-scans determined as part of the counter-measure at step 720 is odd. FIG. 9 illustrates in detail below the series of counter-measures that are attempted as part of the determination at step 720 in FIG. 7.

II. B. Implementation of Counter-Measures

FIG. 9 shows a flowchart 900 of an exemplary computer-implemented process of implementing a series of counter-measures to remediate DC bias build-up in a variable refresh rate display in accordance with embodiments of the present invention. While the various steps in this flowchart are presented and described sequentially, one of ordinary skill will appreciate that some or all of the steps can be executed in different orders and some or all of the steps can be executed in parallel. Further, in one or more embodiments of the invention, one or more of the steps described below can be omitted, repeated, and/or performed in a different order. Accordingly, the specific arrangement of steps shown in FIG. 9 should not be construed as limiting the scope of the invention. Rather, it will be apparent to persons skilled in the relevant art(s) from the teachings provided herein that other functional flows are within the scope and spirit of the present invention. Flowchart 900 may be described with continued reference to exemplary embodiments described above, though the method is not limited to those embodiments.

At step 904, the number of re-scans is reduced by one from the base decision taken at step 704. For example, at step 720 of FIG. 7, the first counter-measure that could be tried is reducing the number of re-scans calculated at step 704 by one. It should be noted that decreasing the number of re-scans by one will increase the duration between the re-scans and that duration may exceed MRI. However, since a counter-measure is an occasional one-time measure, exceeding MRI may be an acceptable sacrifice and would have a negligible effect on the user's experience.

In one embodiment, the process can be programmed to apply this measure infrequently, e.g., at most once per second. The procedure could be programmed with a parameter that keeps track of how often this counter-measure is applied. It will also be noted by one of ordinary skill that reducing the number of re-scans reduces the probability of collisions and, thus, reduces the push-out of the next frame.

In one embodiment, after a decision to take this measure is reached by the procedure, a new re-scan interval duration is also calculated at step 720 before the process continues on to the remaining steps, e.g., 722, 724, 726 and 728.

At step 906, the alternate counter-measure of dropping the input frame entirely can be applied in accordance with the decision made at step 722 of FIG. 7. Because dropping a frame is typically considered to be undesirable, in one embodiment, some stringent conditions can be set by the process for this particular counter-measure to be employed.

For example, certain parameters can be programmed within the process to only allow this counter-measure if the original number of re-scans is calculated to be 0 at step 704, the frame duration is expected to be less than a predetermined threshold (corresponding to a high frame rate e.g., exceeding 100 Hz), and the amount of push-out of the input frame exceeds some predetermined fraction of the frame duration. The conditions ensure that the frame can likely be dropped without noticeable visual artifacts on-screen. However, as explained in connection with step 740, in the unlikely event that a frame is dropped, but the frame duration ends up being much longer than expected, then re-scans of either the dropped frame or the frame prior to the current frame can be inserted until the fresh frame arrives at step 702.

Finally at step 908, the process can increase the number of re-scans by one from the base decision taken at step 704. While it possible that the additional re-scan may not fit within the current frame without forcing some amount of push-out for the next frame, this is an acceptable compromise for using this one-time measure for creating a polarity reversal.

In one embodiment, after a decision to take this measure is reached by the procedure, a new re-scan interval duration is also calculated at step 720 before the process continues on to the remaining steps, e.g., 722, 724, 726 and 728.

It should be noted that the sequence of attempting counter-measures illustrated in FIG. 9 is only exemplary. One of ordinary skill in the art would appreciate that the counter-measures could be attempted in a different order than the one illustrated in FIG. 9.

FIG. 10 illustrates the manner in which a counter-measure can be employed in order to reverse an exemplary polarity pattern in accordance with an embodiment of the present invention. In the example illustrated in FIG. 10, even numbered frames, e.g., frames 0, 2 etc. take 16 ms, odd frames, e.g., frames 1, 3, etc. take 14 ms, scan-outs take 8 ms, and the MRI is 30 ms. Because the frame durations are lower than the MRI, no re-scans are required.

As shown in FIG. 10, before the counter-measure is taken, the even numbered frames have a positive polarity while the odd numbered frames have a negative polarity. Each input frame is painted on the screen just once, with alternating polarity. Because the even numbered frames are slightly longer than the odd numbered frames, a DC imbalance results over time.

If, for example, the DC threshold was exceeded at frame 99 because of this imbalance, then a counter-measure would need to be employed. In the example illustrated in FIG. 10, the counter-measure of inserting an extra re-scan is taken. Because scan-outs take 8 ms, the earliest a re-scan 1037 can be inserted is at 8 ms. However, because frame 99 is an odd numbered frame that was only 14 ms long and because re-scan 1037 takes an additional 8 ms, frame 99 results in a temporal collision with frame 100 and causes a push-out of frame 100 by 2 ms.

III. Counter-Measure Decision Based on a History Buffer

As discussed earlier, in one embodiment, the procedure of FIG. 7 relies on a prediction of an incoming frame size being the same as the prior frame. However, in some cases this prediction may not be true and DC imbalance can result. In one embodiment, a counter-measure can be taken at step 720 based on the contents of a history frame buffer to correct for this imbalance.

Figure 11:
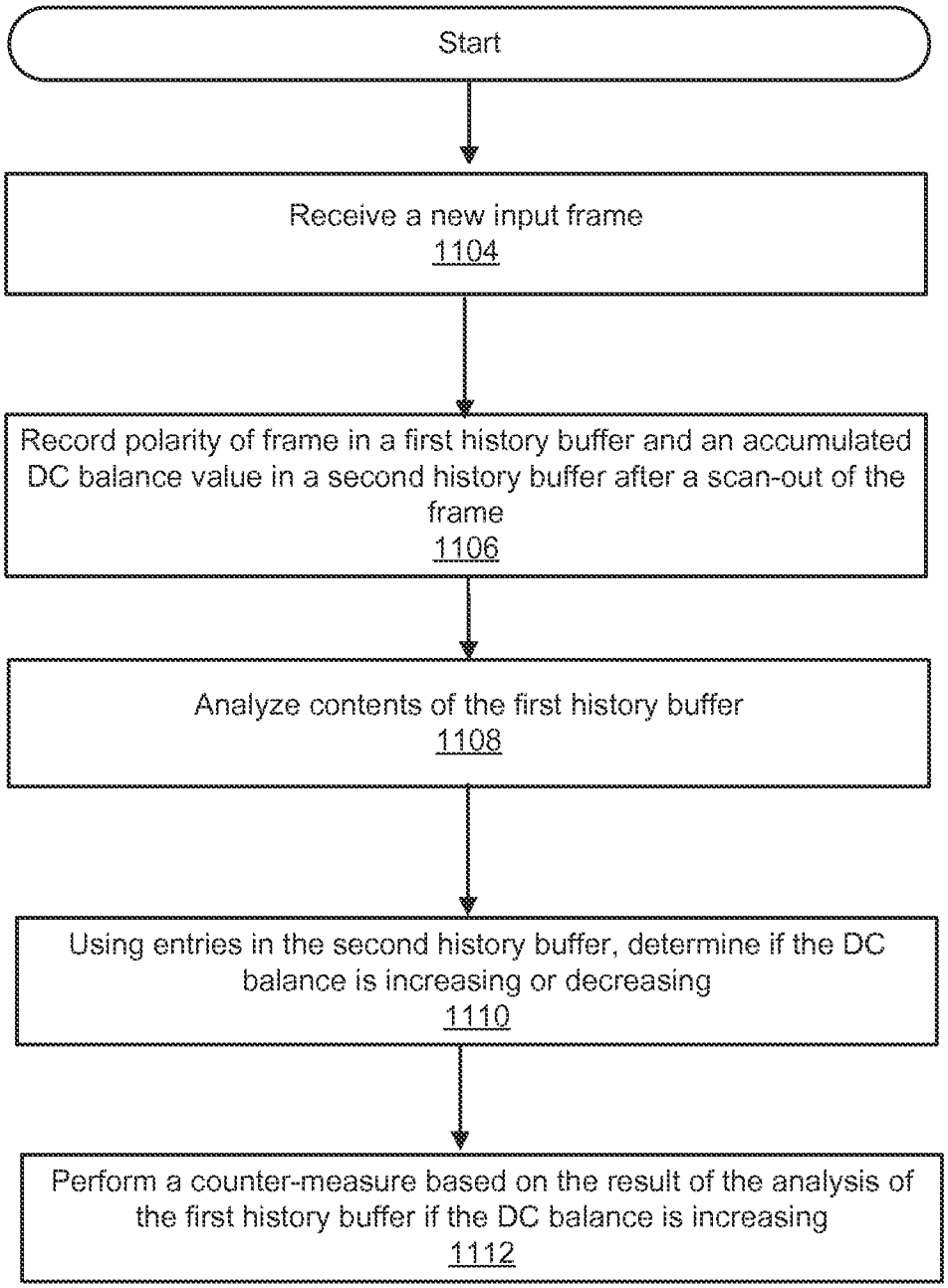
FIG. 11 shows a flowchart of an exemplary computer-implemented process of using a history frame buffer to determine a counter-measure for remediating DC imbalance in a variable refresh rate display in accordance with embodiments of the present invention.

FIG. 11 shows a flowchart 1100 of an exemplary computer-implemented process of using a history frame buffer to determine a counter-measure for remediating DC imbalance in a variable refresh rate display in accordance with embodiments of the present invention. While the various steps in this flowchart are presented and described sequentially, one of ordinary skill will appreciate that some or all of the steps can be executed in different orders and some or all of the steps can be executed in parallel. Further, in one or more embodiments of the invention, one or more of the steps described below can be omitted, repeated, and/or performed in a different order. Accordingly, the specific arrangement of steps shown in FIG. 11 should not be construed as limiting the scope of the invention. Rather, it will be apparent to persons skilled in the relevant art(s) from the teachings provided herein that other functional flows are within the scope and spirit of the present invention. Flowchart 1100 may be described with continued reference to exemplary embodiments described above, though the method is not limited to those embodiments.

At step 1104 an input frame is received. It should be noted that the series of steps that this process comprises is performed for each input frame that is received at step 702 in FIG. 7.

At the start of each new input frame, the polarity of the input frame is recorded in a polarity history buffer at step 1106. The polarity history buffer comprises a polarity record of a plurality of prior input frames. For example, the polarity history buffer can comprise an array of bits representing the polarity of each first scan-out for the last 8 input frames.

Further, at step 1106, an updated DC balance value is recorded in a DC balance history buffer at the start of each first scan-out.

At step 1108, the polarity array is examined to determine a polarity pattern that may be resulting in a DC imbalance.

For example, the polarity pattern could be examined to determine if consecutive frames (neighboring bits in the polarity array) are often the same. If a high number of bits have the same value as the bit immediately preceding them, it is an indication that polarity reversal is likely not being achieved. This may be the case because the frame pattern may comprise alternating long-short duration frame pairs, e.g., a 40 ms frame followed by a 60 ms frame. In this case, because the duration of each frame in the repeating pair of frames is different from the prior frame, the procedure in FIG. 7 may not work because it is based on a predicted frame length, where the prediction uses the length of the prior frame. Accordingly, a DC imbalance may result and examining the history of the polarity pattern allows the process further insight into the reason for the DC bias build-up.

By way of further example, the process can also be programmed to detect other patterns of polarity over a range of first scan-outs, e.g., an irregular polarity pattern such as −++−−++−.

At step 1110, the entries of the DC balance history buffer are used to determine if the DC imbalance is deteriorating. For example, the average of the 2 oldest DC values in the array and the average of the 2 latest DC values in the array could be calculated and compared. From these average values, the process could determine if the DC balance is improving or getting worse. For instance, if both average values were positive or both average values were negative and the absolute value of the average of the 2 latest DC values is greater than the absolute value of the average of the 2 older DC values, it is indicative of the DC imbalance getting worse.

Finally, at step 1112, the process decides a counter-measure if the DC balance is currently exceeding the threshold, e.g., at step 720 in FIG. 7 to implement based on the examination of the contents of polarity history buffer and the DC balance history buffer. For example, if the polarity history buffer is analyzed to determine that most first scan-outs have the same polarity, and the DC balance history buffer is analyzed to determine that the DC imbalance is getting worse, then the process could enforce an even number of re-scans as a counter-measure, instead of a prior prescribed odd value determined at, for example, step 704 in FIG. 7. Alternatively, if the original number of re-scans determined at step 704 is already even, then a counter-measure to enforce that even value can be implemented at step 720 of FIG. 7.

By way of further example, if it is determined that most first scan-outs do have alternating polarity but the DC imbalance is still getting worse and exceeding the threshold, the process can be programmed to enforce a one-time odd number of re-scans rather than the usual countermeasure.

As discussed above, variations on this process are also possible by detecting other patterns of polarity over a range of first scan-outs and taking specific actions. FIG. 12A illustrates a first exemplary polarity history array in accordance with an embodiment of the present invention. In the example illustrated in FIG. 12A, the current frame N has a negative polarity, the frame prior to N is N−1 and has a negative polarity as well, and so forth. An analysis of the polarity history array shows that there is a recognizable pattern of length 4: neg, pos, pos, neg. Based on this pattern, a polarity inversion can be expected to occur from the first scan-out of the current frame to the first scan-out of the next frame (N+1).

If the DC balance history buffer is checked and shows that the DC bias is currently worse at frame N than 8 frames prior, and it is also exceeds the threshold, then a countermeasure that is likely to be successful would be to break this expected inversion by inserting an odd number of re-scans for this frame. If an odd number of re-scans is inserted between frame N and frame N+1, it assures that frame N+1 will have a negative polarity instead of the expected positive one. Further, this decision should take precedence at step 720 over any decision that is just based on the previous frame's duration since it is more likely to be correct, given the larger history that it is based on.

FIG. 12B illustrates a first exemplary polarity history array in accordance with an embodiment of the present invention. As shown in FIG. 12B, 7 out of the 8 frames do not result in an inversion of a first-scan polarity as compared to a respective prior frame. Accordingly, a reasonable prediction for the polarity of frame N+1 is negative assuming that the first-scan polarity stays the same as frame N. In order to break a growing DC balance, an inversion can be forced in this case by inserting an even number of re-scans (or none).

It should be noted that the history buffer is analyzed to see if a recognizable pattern exist. Based on this, a prediction is made of what will happen for the current input frame versus the next input frame, assuming this detected pattern continues. If no pattern can be detected, then no history-based prediction can be made and this method will not be able to produce a counter measure. In such a case, the procedure will likely revert to other techniques of controlling the DC imbalance.

If a pattern is detected, then according to this history analysis result, the next input frame's first scan-out polarity is predicted to either become inverted or not (as compared to that of current input frame), assuming the pattern continues.

In that case, if the DC balance is over the threshold and increasing (in magnitude) then the history based counter measure will enforce the inverse of this prediction, i.e. select an even or odd number of rescans such that the prediction will not come true in order to break the pattern.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered as examples because many other architectures can be implemented to achieve the same functionality.

The process parameters and sequence of steps described and/or illustrated herein are given by way of example only. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

While various embodiments have been described and/or illustrated herein in the context of fully functional computing systems, one or more of these example embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. These software modules may configure a computing system to perform one or more of the example embodiments disclosed herein. One or more of the software modules disclosed herein may be implemented in a cloud computing environment. Cloud computing environments may provide various services and applications via the Internet. These cloud-based services (e.g., software as a service, platform as a service, infrastructure as a service, etc.) may be accessible through a Web browser or other remote interface. Various functions described herein may be provided through a remote desktop environment or any other cloud-based computing environment.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as may be suited to the particular use contemplated.

Embodiments according to the invention are thus described. While the present disclosure has been described in particular embodiments, it should be appreciated that the invention should not be construed as limited by such embodiments, but rather construed according to the below claims.

What is claimed is:

1. A method for driving a display panel having a variable refresh rate, said method comprising:

a) receiving a current input frame from an image source;

b) determining a first number of re-scanned frames to insert between said current input frame and a subsequent input frame, wherein said re-scanned frames repeat said current input frame, and wherein said determining depends on a minimum refresh interval (MRI) of said display panel;

c) calculating respective intervals at which to insert said first number of re-scanned frames between said current input frame and said subsequent input frame;

d) scanning said current input frame for display on said display panel; and e) inserting said first number of re-scanned frames at said respective intervals between said current input frame and said subsequent input frame from said image source, wherein said inserting is operable to reduce charge accumulation in said display panel.

2. The method of claim 1, wherein said respective intervals are spaced at equi-distant durations between said current input frame and said subsequent input frame.

3. The method of claim 1, wherein said determining further comprises:

calculating a minimum number of re-scanned frames that can be inserted in a duration between said current input frame and said subsequent input frame based on said MRI;

calculating a maximum number of re-scanned frames that can be inserted in said duration;

choosing a lowest even numbered value greater than or equal to said minimum number, wherein said lowest even numbered value does not exceed said maximum number; and choosing a lowest odd numbered value if said lowest even numbered value is unavailable.

4. The method of claim 1, further comprising:

repeating said a) to e) for said subsequent input frame.

5. The method of claim 1, further comprising:

determining if said charge accumulation in said display panel has crossed over a predetermined threshold value;

responsive to a determination that said charge accumulation has crossed over said predetermined threshold value, determining a second number of re-scanned frames and corresponding intervals at which to insert said second number of re-scanned frames; and inserting said second number of re-scanned frames at said corresponding intervals in between said current input frame and said subsequent input frame.

6. The method of claim 1, wherein said image source is a graphics processing unit (GPU).

7. The method of claim 1, further comprising:

using an estimated time duration of said current input frame to perform said determining and said calculating; and inserting additional re-scanned frames after said first number of re-scanned frame if said subsequent input frame does not arrive within said estimated time duration.

8. A non-transitory computer-readable storage medium having stored thereon, computer executable instructions that, if executed by a computer system cause the computer system to perform a method for driving a display panel having a variable refresh rate, said method comprising:

a) receiving a current input frame from an image source;

b) determining a first number of re-scanned frames to insert between said current input frame and a subsequent input frame, wherein said re-scanned frames repeat said current input frame, and wherein said determining depends on a minimum refresh interval (MRI) of said display panel;

c) calculating respective intervals at which to insert said first number of re-scanned frames between said current input frame and said subsequent input frame;

d) scanning said current input frame for display on said display panel; and e) inserting said first number of re-scanned frames at said respective intervals between said current input frame and said subsequent input frame from said image source, wherein said inserting is operable to reduce charge accumulation in said display panel.

9. The computer-readable storage medium of claim 8, wherein said intervals are spaced at equi-distant durations between said current input frame and said subsequent input frame.

10. The computer-readable storage medium of claim 8, wherein said determining further comprises:

calculating a minimum number of re-scanned frames that can be inserted in a duration between said current input frame and said subsequent input frame based on said MRI;

calculating a maximum number of re-scanned frames that can be inserted in said duration;

choosing a lowest even numbered value greater than or equal to said minimum number, wherein said lowest even numbered value does not exceed said maximum number; and choosing a lowest odd numbered value if said lowest even numbered value is unavailable.

11. The computer-readable storage medium of claim 8, wherein said method further comprises:

repeating said a) to e) for said subsequent input frame.

12. The computer-readable storage medium of claim 8, wherein said method further comprises:

determining if said charge accumulation in said display panel has crossed over a predetermined threshold value;

responsive to a determination that said charge accumulation has crossed over said predetermined threshold value, determining a second number of re-scanned frames and corresponding intervals at which to insert said second number of re-scanned frames; and inserting said second number of re-scanned frames at said corresponding intervals in between said current input frame and said subsequent input frame.

13. The computer-readable storage medium of claim 8, wherein said image source is a graphics processing unit (GPU).

14. The computer-readable storage medium of claim 8, wherein said method further comprises:

using an estimated time duration of said current input frame to perform said determining and said calculating; and inserting additional re-scanned frames after said first number of re-scanned frame if said subsequent input frame does not arrive within said estimated time duration.

15. A system comprising:

a variable refresh rate display;

a memory for storing images from an image source;

a processor coupled to said memory, said processor operable to implement a method for driving a display panel having a variable refresh rate, said method comprising:

a) receiving a current input frame from an image source;

b) determining a first number of re-scanned frames to insert between said current input frame and a subsequent input frame, wherein said re-scanned frames repeat said current input frame, and wherein said determining depends on a minimum refresh interval (MRI) of said display panel;

c) calculating respective intervals at which to insert said first number of re-scanned frames between said current input frame and said subsequent input frame;

d) scanning said current input frame for display on said display panel; and e) inserting said first number of re-scanned frames at said respective intervals between said current input frame and said subsequent input frame from said image source, wherein said inserting is operable to reduce charge accumulation in said display panel.

16. The system of claim 15, wherein said intervals are spaced at equi-distant durations between said current input frame and said subsequent input frame.

17. The system of claim 15, wherein said determining further comprises:

calculating a minimum number of re-scanned frames that can be inserted in a duration between said current input frame and said subsequent input frame based on said MRI;

calculating a maximum number of re-scanned frames that can be inserted in said duration;

choosing a lowest even numbered value greater than or equal to said minimum number, wherein said lowest even numbered value does not exceed said maximum number; and choosing a lowest odd numbered value if said lowest even numbered value is unavailable.

18. The system of claim 15, wherein said method further comprises:

repeating said a) to e) for said subsequent input frame.

19. The system of claim 15, wherein said method further comprises:

determining if said charge accumulation in said display panel has crossed over a predetermined threshold value;

responsive to a determination that said charge accumulation has crossed over said predetermined threshold value, determining a second number of re-scanned frames and corresponding intervals at which to insert said second number of re-scanned frames; and inserting said second number of re-scanned frames at said corresponding intervals in between said current input frame and said subsequent input frame.

20. The system of claim 19, wherein said image source is a graphics processing unit (GPU).

21. The system of claim 15, wherein said method further comprises:

using an estimated time duration of said current input frame to perform said determining and said calculating;

inserting additional re-scanned frames after said first number of re-scanned frame if said subsequent input frame does not arrive within said estimated time duration.

* * * * *